United States Patent [19]

Desvallées et al.

[11] Patent Number: 4,901,554

[45] Date of Patent: Feb. 20, 1990

[54] UNIVERSAL FINISHING STAND FOR THE UNIVERSAL ROLLING OF RAILS AND THE LIKE, AND METHOD OF UTILIZING SAME

[75] Inventors: Jean Desvallées, Antibes; Jacques Michaux, Guenange; Gabriel Mennel, Nilvange, all of France

[73] Assignee: Unimetal - Societe Francaise des Aciers Longs, Metz, France

[21] Appl. No.: 127,361

[22] Filed: Dec. 2, 1987

[30] Foreign Application Priority Data

Mar. 13, 1987 [FR] France ..... 87 03609

[51] Int. Cl.[4] ..... B21B 13/10

[52] U.S. Cl. ..... 72/225; 72/229

[58] Field of Search ..... 72/229, 225, 226, 224

[56] References Cited

U.S. PATENT DOCUMENTS 1,301,414 4/1919 Fawell ..... 72/229 X

FOREIGN PATENT DOCUMENTS 0135406 6/1986 Japan ..... 72/229

*Primary Examiner*—W. Donald Bray

*Attorney, Agent, or Firm*—Bacon & Thomas

[57] ABSTRACT

A universal finishing stand in which the rolling wheels of the horizontal rolls are disposed and eccentric to the transverse central planes of the corresponding rolling tables and adjacent the vertical laminating roll in order to form a space defined by the passive faces of the rolling wheels and a support post through which a rail blank may be freely passed during the edging and universal rolling passes. In another embodiment, the space is temporarily formed by shifting the horizontal rolls along their axes of rotation.

8 Claims, 3 Drawing Sheets

FIG. 4a
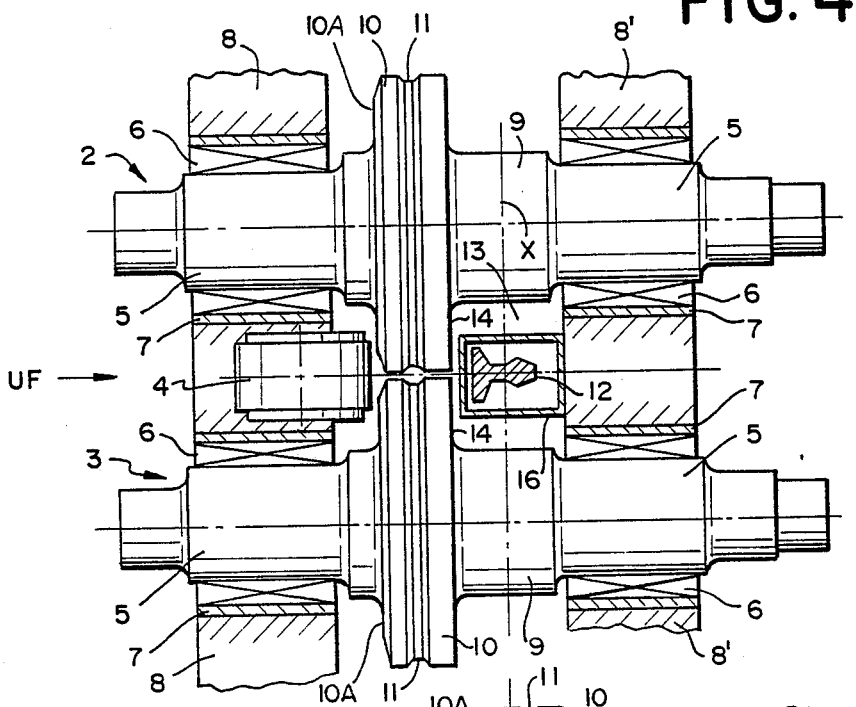
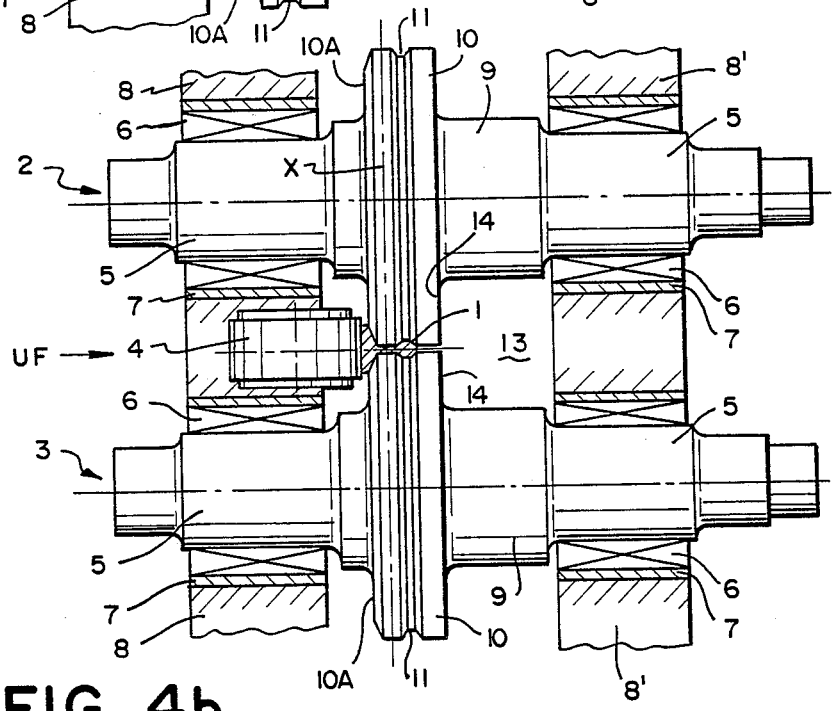
FIG. 4b

UNIVERSAL FINISHING STAND FOR THE UNIVERSAL ROLLING OF RAILS AND THE LIKE, AND METHOD OF UTILIZING SAME

BACKGROUND OF THE INVENTION

1. Field of the Invention

The present invention generally involves the field of technology pertaining to the mechanical treatment of metal workpieces. More particularly, the invention relates to the universal rolling of shaped metal members, especially steel rails and the like.

2. Description of the Prior Art

A conventional mill for rolling various shaped metal members, such as rails, girders, groove-and-tongue pilings, U-shaped channels, and the like, typically involves directing the member along a processing or rolling line. The initial upstream point of the line includes an oven for heating the semi-product, such as a bloom, ingot or the like. Proceeding downstream along the line, in sequential order, are a first set of reversing roughing stands for shaping the metal blank, a second reversing or intermediary set including at least one universal stand and an edger which can be moved in a direction perpendicular to the longitudinal axis of the line in order to remove same entirely out of the line, and a universal finishing stand for imparting the final shape to the member.

The universal finishing stand of a conventional rolling line is normally disposed at a considerable distance from the second reversing or intermediary set, with the distance exceeding the length of the longest shaped section being processed in the line. This distance may be on the order of a hundred meters in conventional practice. Because of this large distance, it has been proposed in the making of girders by universal rolling to move the universal finishing stand closer to the intermediary set in order to reduce construction costs by forming a single set of stands which consist of a first reversing universal stand, a second reversing edger and a first universal finishing stand. The rolled girder shall pass several times through this set of stands before they arrive at a transfer table for cutting to the desired length.

In one example of a known rolling procedure, a girder blank is consecutively rolled during a first pass from upstream to downstream by the reversing universal stand and the reversing edger, during a second pass from downstream to upstream by the reversing edger and the reversing universal stand, and during a third pass from upstream to downstream by the reversing edger and the universal finishing stand. During this procedure, the universal finishing stand is not utilized during the first and second passes, so that the rolled blank must be freely passed in sequence at the universal finishing stand. There are two known proposals for accommodating this latter requirement. First, the rolls of the unused stand may be separated, but this technique prevents maintaining the three-set adjustment in the finishing pass and is incompatible with utilizing the entry and exit guides of rolls provided specifically in a rail finishing stand. Moreover, the nature of the shape of a rail blank, especially the height of the rail head, requires a greater roll separation than for another type of blank, such as a girder blank. Second, it is also known to remove the universal stand from the rolling line in a direction perpendicular to the longitudinal axis of the line. However, this solution is also disadvantageous since it would be required to move the stand entirely out of the rolling line between the prior pass and the finishing pass, resulting in prohibitive loss of time and reduction in the overall efficiency of the rolling operation.

SUMMARY OF THE INVENTION

It is an object of the present invention to provide an improved universal finishing stand which efficiently permits free product passage through the stand.

It is another object of the invention to provide an improved universal finishing stand which may be economically and easily constructed.

These and other objects of the invention are realized through an improved universal finishing stand which comprises a pair of horizontal rolls journaled for rotation at their opposite ends within a pair of respective support posts, with a vertical laminating roll being disposed therebetween. Each horizontal roll includes a rolling table on which a rolling wheel is supported and eccentrically disposed adjacent the vertical laminating roll with respect to the tranverse central plane of the rolling table. The rolling wheels are each provided with a finishing groove and further includes an active face directed towards the vertical laminating roll and an opposite passive face. The eccentric disposition of the rolling wheels forms a space defined in part by the passive faces and the support post opposite the passive faces for permitting free passage of the product being rolled through the stand. The horizontal rolls are disposable in two positions relative to a rolling axis, including an operational position in which the product is rolled in the finishing grooves of the rolling wheels, and a waiting position in which the product is permitted to freely pass through the space. Disposition of the horizontal rolls into the operational and waiting positions is realized by shifting the stand in a direction transverse to the longitudinal axis of the rolling line.

Other objects, features and advantages of the invention shall become apparent from the following detailed description of preferred embodiments thereof when taken in conjunction with the attached drawings wherein like reference characters refer to corresponding parts of the several views.

BRIEF DESCRIPTION OF THE DRAWINGS

FIG. 4*a* is a vertical sectional view of a universal finishing stand according to a preferred embodiment of the invention and shown in a waiting position; and FIG. 4*b* is a vertical sectional view of the stand depicted in FIG. 4*a* but shown in an operational position.

DETAILED DESCRIPTION OF THE PREFERRED EMBODIMENTS

Figure 1:
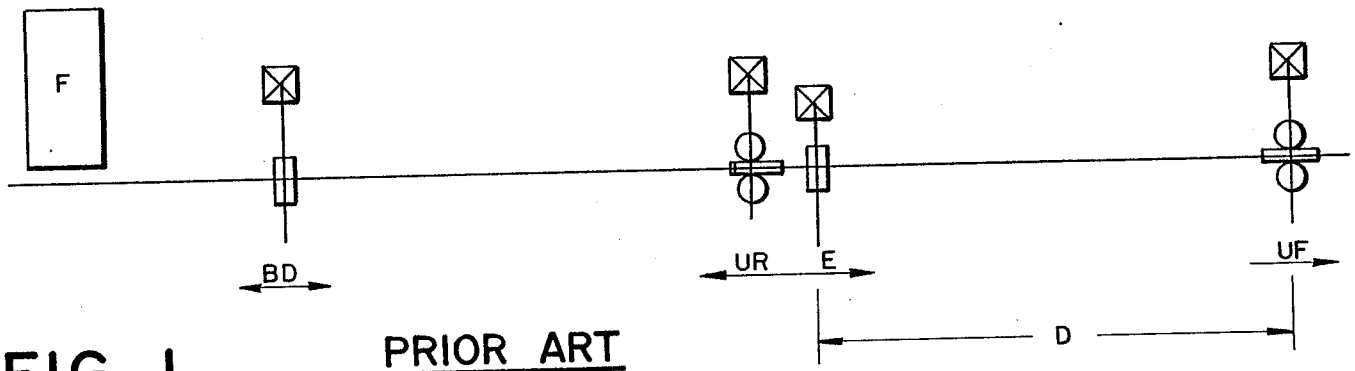
PRIOR ART FIG. 1
FIG. 1 is a schematic representation of a conventional rolling mill line as used in the universal rolling of beams or similar metal members.

A conventional mill for the universal rolling of shaped metal members, such as rails, girders and the like, shall be described with initial reference to FIG. 1. As shown therein, the mill comprises a rolling line defined by a series of stations, beginning with a heating oven F for the metal blanks at the furthest upstream point of the rolling line, followed sequentially by a first set of reversing roughing stands BD for shaping the blanks, a second reversing or intermediary set including at least one universal stand UR and an edger E which can be moved perpendicular to the longitudinal axis of the rolling line in order to remove same entirely out of the line as required, and a universal finishing stand UF for imparting the final shape to the blank. As also noted, the universal finishing stand UF is normally spaced a considerable distance D from the intermediary set UR and E. Distance D exceeds the length of the longest shaped member being processed by the line, and may be on the order of a hundred meters.

Figure 2:
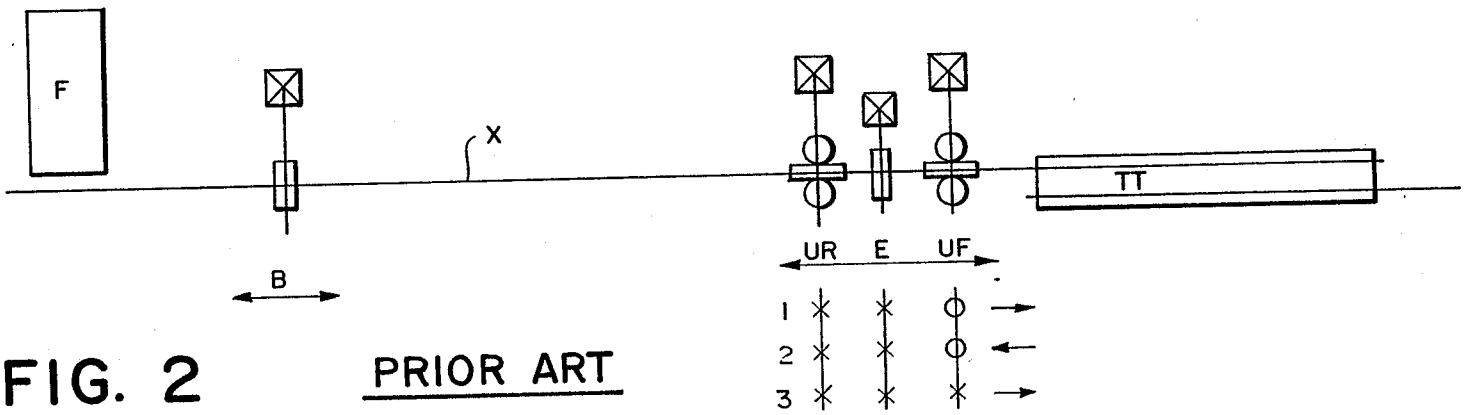
PRIOR ART FIG. 2
FIG. 2 is a schematic representation of a rolling mill line similar to that shown in FIG. 1, but wherein the universal finishing stand is disposed adjacent the universal edger.

As shown in FIG. 2, the forming of girders or similar members by universal rolling in a mill of the type shown in FIG. 1 may be accomplished by disposing the universal finishing stand UF closer to the intermediary set UR and E. In this way, a single set of stands is defined by a first reversing universal stand UR, a second reversing edger E and a first universal finishing stand UF, a configuration which reduces construction costs of the mill. In shaping a metal blank by the line of FIG. 2, the blank is consecutively rolled during its first pass from upstream to downstream by the reversing universal stand UR, and thereafter by the reversing edger E, during its second pass from downstream to upstream the blank is rolled by the edger E and thereafter by the universal finishing stand UR, and finally during the third pass, from upstream to downstream, the blank is rolled by the edger E and thereafter by the reversing universal stand UF.

A conventional universal finishing stand UF shall now be described with reference to FIG. 3. Stand UF is used for the finishing pass of a rail 1 and includes a pair of horizontal rolls 2 and 3, and a vertical roll 4 disposed therebetween. Horizontal rolls 2 and 3 are each provided with opposed ends 5 which are in turn journaled for rotation in spaced support posts 8 and 8′ by means of bearings 6 which are housed in chocks 7. The mounting of chocks 7 in their corresponding support posts 8 and 8′ may be accomplished in any manner well-known in the prior art. Horizontal roll 2 and 3 are each provided with a rolling table 9 disposed between support posts 8 and 8′. Each rolling table 9 is in turn provided with a centrally disposed rolling wheel 10 having a finishing groove 11 formed within the peripheral surface. Rolling wheels 10 are each provided with an active face 10A directed towards vertical roll 4, and an opposite passive face 14. It is therefore apparent that the peripheral surface of vertical roll 4, active faces 10A of wheels 10 and finishing grooves 11 collectively define the configured forming faces corresponding to the head, web and fishplate zones of the foot of rail 1. Stand UF is also provided with displacing means (not shown) for the purpose of moving stand UF in a direction that is generally transverse or perpendicular with respect to the longitudinal axis of the rolling line.

When the edging and universal passes are carried out on universal stands UR and edgers E disposed upstream of the universal finishing stand UF, the blank must be allowed to freely move to the site of the universal finishing stand UF. In order to accommodate this procedure, the known procedures of either moving stand UF entirely out of the rolling line or separating the rolls in order to permit the rolled blank to pass during the edging and the universal passes must be utilized. In order to overcome the aforementioned problems inherent in a conventional universal finishing stand, an improved finishing stand UF has been provided and shall now be hereinafter explained in detail with particular reference to FIGS. 4*a* and 4*b*.

As shown in FIG. 4*a*, a universal finishing stand UF in accordance with a preferred embodiment of the invention also includes a pair of horizontal rolls 2 and 3 journaled for rotation at their opposed ends 5 in corresponding bearings 6 and chocks 7 secured in an appropriate manner within spaced support posts 8 and 8′. As further noted, horizontal rolls 2 and 3 are each provided with a rolling table 9 disposed between support posts 8 and 8′. Moreover, each rolling table 9 is provided with a corresponding rolling wheel 10 having a finishing groove 11 in the periphery thereof, with each wheel 10 also including an active face 10A directed towards a vertical laminating roll 4 and an opposite passive face 14 facing support post 8′.

As is apparent in FIG. 4*a*, each rolling wheel 10 is disposed eccentrically with respect to the tranverse central plane of its corresponding rolling table 9, towards one end of table 9 and adjacent to the peripheral face of vertical roll 4. In this way, passive faces 14 of wheels 10 and the corresponding opposed side of support post 8′ define a space 13 through which a rail blank 12 may be freely passed during the edging and universal rolling passes. As also shown, space 13 is partially defined by bearings 6, chocks 7 and portions of rolling tables 9 corresponding to support post 8′. Thus, the central plane of each rolling wheel 10 is offset from a corresponding transverse central plane of its corresponding rolling table 9. The position of stand UF in FIG. 4*a* with respect to a rolling axis X disposes stand UF in a waiting position, thereby permitting the free passage of blank 12 through space 13 during the edging and universal rolling passes. Stand UF is moved into this position in a direction that is perpendicular to the longitudinal axis of the rolling line. When stand UF is in the waiting position, axis X is disposed at the center of space 13.

In order to dispose stand UF into its operational position as shown in FIG. 4*b*, it is required that stand UF be displaced transversely, thereby shifting axis X to rolling wheels 10 and permitting blank 12 to be engaged by the respective forming surfaces defined by vertical roll 4, rolling wheels 10 and the active faces 10A of wheels 10. The degree of this displacement may be a slight distance, such as about forty centimeters in actual practice. Thus, it is only necessary to effect this transverse displacement in either direction so as to place stand UF in its corresponding waiting and operational positions, as shown in FIGS. 4*a* and 4*b*, respectively.

In order to protect rolling wheels 10, rolling tables 9, bearings 6 and chocks 7 defining space 13, stand UF may advantageously be provided with a guide 16 in the form of a conduit having an appropriate cross-sectional configuration for lining space 13, and through which guide 16 the blank 12 is caused to freely pass as shown in FIG. 4*a*.

Figure 3:
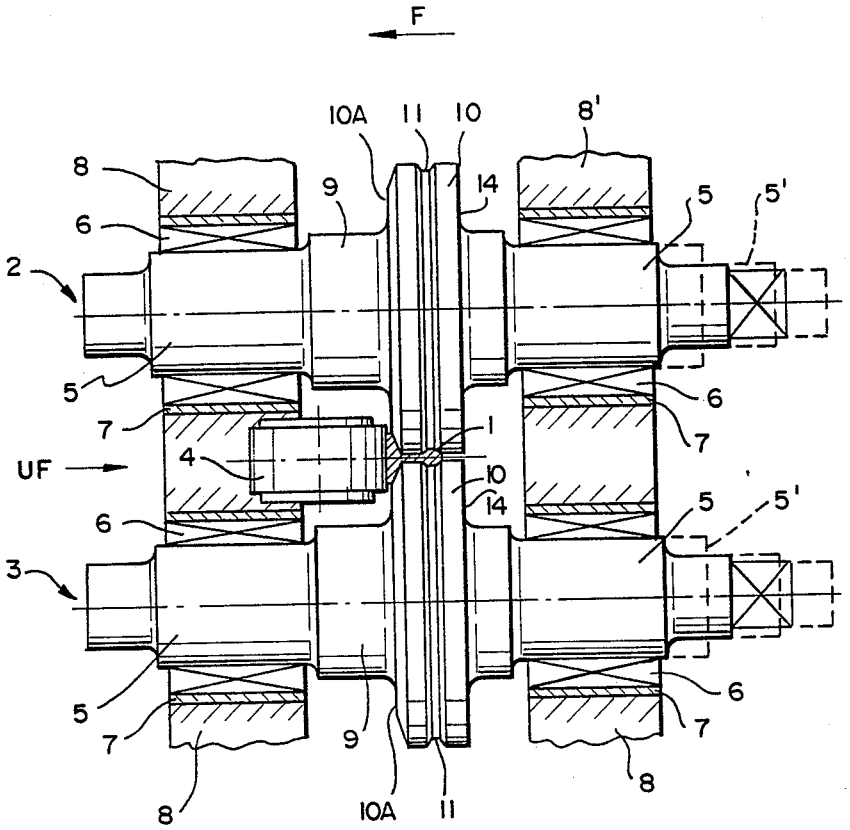
FIG. 3 is a vertical sectional view of a conventional universal finishing stand utilized in the universal rolling of rails with portions of the horizontal rolls shown in dotted lines to depict an improvement thereto according to an embodiment of the invention.

It is further possible through practice of the invention to utilize longer horizontal rolls 5', as shown in dotted lines in FIG. 3 supported for rotation in stationary support posts so that displacement between the waiting and operational positions is implemented by simply shifting or translating the horizontal rolls along their axes of rotation relative to the support posts in the horizontal direction indicated by Arrow F. This alternative embodiment does not require disposing the rolling wheels in an eccentric position relative to their corresponding rolling tables since the temporary space defined by this arrangement may be varied in size and opened only while passing the blank when the stand is in its waiting position. The invention provides a significant advantage in that it permits the universal rolling of rails by a universal finishing stand used for rolling beams to be transformed into a universal stand UF capable of being utilized in a reversing intermediate set without the need for substantial modification. Another advantage of the invention resides in the fact that a universal finishing stand incorporating the invention in a rolling line procedure is only required to be displaced a very small distance, thereby avoiding a total withdrawal of the stand from the rolling line as now required in conventional practice. Since only a limited displacement of the stand is necessary, its displacement between waiting and operational positions can be accomplished very quickly. A further advantage of the invention resides in the fact that its utilization eliminates the need for equipment controlling the separation and monitoring in rail rolling procedures.

The foregoing shall be considered as only illustrative of the present invention, as exemplified by the preferred embodiments described herein, since numerous modifications and changes shall readily occur to those skilled in the art. It is therefore understood that the invention should not be limited to the exact construction and operation shown and described herein, but that all suitable modifications and equivalents may be resorted to within the scope of the invention as hereinafter claimed.

We claim:

1. An improved universal finishing stand for the universal rolling of rails and other shaped metal members in a universal rolling process during which the stand is disposed in a waiting position, the stand being of the type including a pair of horizontal rolls having opposed ends journaled for rotation in spaced support posts, a vertical laminating roll disposed between the horizontal rolls, each horizontal roll including a rolling table positioned between the support posts and a rolling wheel carried by each rolling table, each rolling wheel including a peripheral finishing groove, an active surface directed towards the periphery of the vertical laminating roll, and an opposite passive surface, the improvement comprising the passive faces and a corresponding opposed support post defining in part a space at least temporarily of sufficient size to permit free passage of a rail blank therethrough during the universal rolling process when the stand is in a waiting position.

2. The stand of claim 1 further including means disposed within the space for guiding the rail blank therethrough.

3. A method for the universal rolling of a rail blank or similar metal member in a rolling line that includes a reversing universal stand and a reversing edger comprising the steps of:

(a) positioning a universal finishing stand adjacent the reversing universal stand and reversing edger, wherein the finishing stand is partially defined by a pair of horizontal rolls journaled at their opposite ends for rotation in a pair of spaced support posts, a vertical laminating roll disposed between the horizontal rolls, and each horizontal roll including a rolling table and an associated rolling wheel, with each rolling wheel including a finishing groove and opposite active and passive faces;

(b) alternately disposing the stand between a waiting position during which a space is at least temporarily formed and defined in part by the passive faces of the rolling wheel and an opposed support post whereby the blank may be freely passed through the space, and an operational position during which the blank may be passed between corresponding forming surfaces of the vertical laminating roll, the finishing grooves and active faces of the rolling wheels.

4. An improved universal finishing stand for the universal rolling of rails and other shaped metal members in a universal rolling process during which the stand is disposed in a waiting position, the stand being of the type including a pair of horizontal rolls having opposed ends journaled for rotation in spaced support posts, a vertical laminating roll disposed between the horizontal rolls, each horizontal roll including a rolling table positioned between the support posts and a rolling wheel carried by each rolling table, each rolling wheel including a peripheral finishing groove, an active surface directed towards the periphery of the vertical laminating roll, and an opposite passive surface, the improvement comprising the passive faces and a corresponding opposed support post defining in part a space at least temporarily of sufficient size to permit free passage of a rail blank therethrough during the universal rolling process when the stand is in a waiting position, and including a conduit disposed within the space through which the rail blank is permitted to freely pass for guiding the rail blank through the space.

5. An improved universal finishing stand for the universal rolling of rails and other shaped metal members in a universal rolling process during which the stand is disposed in a waiting position, the stand being of the type including a pair of horizontal rolls having opposed ends journaled for rotation in spaced support posts, a vertical laminating roll disposed between the horizontal rolls, each horizontal roll including a rolling table positioned between the support posts and a rolling wheel carried by each rolling table, each rolling wheel including a peripheral finishing groove, an active surface directed towards the periphery of the vertical laminating roll, and an opposite passive surface, the improvement comprising the passive faces and a corresponding opposed support post defining in part a space at least temporarily of sufficient size to permit free passage of a rail blank therethrough during the universal rolling process when the stand is in a waiting position, the space being formed by positioning the rolling wheels eccentrically with respect to the transverse central planes of their corresponding rolling tables and toward the vertical roll.

6. An improved universal finishing stand for the universal rolling of rails and other shaped metal members in a universal rolling process during which the stand is disposed in a waiting position, the stand being of the type including a pair of horizontal rolls having opposed ends journaled for rotation in spaced support posts, a vertical laminating roll disposed between the horizontal rolls, each horizontal roll including a rolling table positioned between the support posts and a rolling wheel carried by each rolling table, each rolling wheel including a peripheral finishing groove, an active surface directed towards the periphery of the vertical laminating roll, and an opposite passive surface, the improvement comprising the passive faces and a corresponding opposed support post defining in part a space at least temporarily of sufficient size to permit free passage of a rail blank therethrough during the universal rolling process when the stand is in a waiting position, wherein the support posts are stationary, the ends of the horizontal rolls being further journaled for translational movement along their respective axes of rotation, and the space is temporarily formed by displacing the horizontal rolls along the axes of rotation.

7. A method for the universal rolling of a rail blank or similar metal member in a rolling line that includes a reversing universal stand and a reversing edger comprising the steps of:

(a) positioning a universal finishing stand adjacent the reversing universal stand and reversing edger, wherein the finishing stand is partially defined by a pair of horizontal rolls journaled at their opposite ends for rotation in a pair of spaced support posts, a vertical laminating roll disposed between the horizontal rolls, and each horizontal roll including a rolling table and an associated rolling wheel, with each rolling wheel including a finishing groove and opposite active and passive faces; and (b) alternately disposing the stand between a waiting position during which a space is at least temporarily formed by displacing the stand relative and transverse to the longitudinal axis of the rolling line, the space being defined in part by the passive faces of the rolling wheel and an opposed support post whereby the blank may be freely passed through the space, and an operational position during which the blank may be passed between corresponding forming surfaces of the vertical laminating roll, the finishing grooves and active faces of the rolling wheels.

8. A method for the universal rolling of a rail blank or similar metal member in a rolling line that includes a reversing universal stand and a reversing edger comprising the steps of:

(a) positioning a universal finishing stand adjacent the reversing universal stand and reversing edger, wherein the finishing stand is partially defined by a pair of horizontal rolls journaled at their opposite ends for rotation in a pair of spaced support posts, a vertical laminating roll disposed between the horizontal rolls, and each horizontal roll including a rolling table and an associated rolling wheel, with each rolling wheel including a finishing groove and opposite active and passive faces; and (b) alternately disposing the stand between a waiting position during which a space is at least temporarily formed by laterally displacing the horizontal rolls along their respective axes of rotation and relative to the support posts, the space being defined in part by the passive faces of the rolling wheel and in opposed support posts whereby the blank may be freely passed through the space, and an operational position during which the blank may be passed between corresponding forming surfaces of the vertical laminating roll, the finishing grooves and active faces of the rolling wheels.

* * * * *